United States Patent [19]

Brooks et al.

[11] Patent Number: 4,625,539

[45] Date of Patent: Dec. 2, 1986

[54] AUTOMATIC CRIMPER AND CRIMPING DIE

[75] Inventors: Thomas W. Brooks, Springfield, Mo.; David A. Masseth, Centerville; Joseph R. Malecka, Kettering, both of Ohio; C. Edward Stiver; Charles S. Pearson, both of Ocala, Fla.; James D. Fox, Westchester, Ohio

[73] Assignee: Dayco Corporation, Dayton, Ohio

[21] Appl. No.: 695,707

[22] Filed: Jan. 28, 1985

[51] Int. Cl.[4] ..... B21D 41/04

[52] U.S. Cl. ..... 72/402; 72/26; 72/30; 29/237

[58] Field of Search ..... 72/26, 30, 402, 399; 29/237; 192/138, 143; 100/257

[56] References Cited

U.S. PATENT DOCUMENTS

| | | | |
|---|---|---|---|
| 2,302,674 | 11/1942 | Carter | 72/402 |
| 2,889,507 | 6/1959 | Kennedy et al. | 100/257 |
| 3,093,182 | 6/1963 | Vanderhoof | 72/402 |
| 3,568,494 | 3/1971 | Geisman | 72/402 |
| 3,736,788 | 6/1973 | Olive-Jones et al. | 72/402 |
| 3,762,209 | 10/1973 | Herndon et al. | 72/402 |
| 3,851,514 | 12/1974 | Chen et al. | 72/402 |
| 4,071,936 | 2/1978 | Smith | 72/402 |
| 4,244,091 | 1/1981 | Kimble et al. | 72/402 |
| 4,250,607 | 2/1981 | Lillbacka et al. | 72/402 |
| 4,285,228 | 8/1981 | Gunning | 72/402 |
| 4,306,442 | 12/1981 | Schrock | 72/402 |
| 4,515,006 | 5/1985 | Stanley | 72/402 |

FOREIGN PATENT DOCUMENTS

| | | | |
|---|---|---|---|
| 162966 | 4/1949 | Austria | 72/402 |
| 1193848 | 6/1970 | United Kingdom | 72/26 |
| 305951 | 6/1971 | U.S.S.R. | 72/402 |

*Primary Examiner*—Daniel C. Crane

*Attorney, Agent, or Firm*—Joseph V. Tassone

[57] ABSTRACT

A crimping die assembly comprising a plurality of die fingers, a holding unit for holding the die fingers in a working relationship, the holding unit comprising a retaining ring having a plurality of substantially evenly spaced openings for receiving the die fingers therein for holding the die fingers at one end of the die assembly, each die finger having a connecting part connecting the die finger to the retaining ring, each connecting part permitting radial movement of its respective die finger with respect to the central axis of the retaining ring, and a springing arrangement integrally associated with the connecting parts tending to force the die fingers radially outwardly with respect to the retaining ring, the top surfaces of the die fingers extending beyond the top surface of the retaining ring so as to receive pressing forces directly from a ram through a pusher ring that engages the top surfaces of the die fingers when the crimping die is used to crimp a workpiece.

6 Claims, 18 Drawing Figures

AUTOMATIC CRIMPER AND CRIMPING DIE

BACKGROUND OF THF INVENTION

1. Field of the Invention

The present invention relates to a machine for crimping a workpiece, such as a coupling on a hose; a crimping die assembly; and a method for their use.

2. Prior Art Statement

Crimping machines, together with associated crimping dies and pusher assemblies, are used in those applications where an evenly distributed, circumferentially applied force is needed to reduce the diameter of a workpiece without radial distortion. In order to provide an evenly distributed, circumferentially applied force, crimping machines conventionally employ crimping dies comprising a plurality of die fingers which are disposed around the workpiece, and have a curved inside surface adjacent the workpiece which substantially matches the curvature of the workpiece. A ram and driving means are provided to apply a pressing force to the crimping die through a pusher assembly, the pusher assembly being provided to control the amount of the crimp and to assure that the pressing forces of the ram are applied evenly to the die assembly. Means are provided for transferring the linear forces of the ram into radially applied forces on each of the die fingers, causing the die fingers to move uniformly to reduce the diameter of the die fingers such that the die fingers each contact the workpiece with substantially equal force.

Because of the large variety of sizes and types of work pieces that require crimping, prior art crimping devices require a large number of crimping dies, a variety of pusher assemblies, and means by which the operator controls the pressure applied to the workpiece in the crimping operation.

Geizman, in U.S. Pat. No. 3,568,494, teaches a crimping machine having radially disposed crimping jaws and a crimping ring having an internal conical shape for moving said crimping jaws radially inward.

Herndon et al, in U.S. Pat. No. 3,762,209, teach a crimping apparatus having a die head which moves on a central horizontal longitudinal axis and has a plurality of spaced slots therein, each slot having an associated die finger. Each die finger is supported independently within its slot for movement transverse to the longitudinal axis. Each die finger has a spring associated externally therewith for holding each die finger in its slot.

Chen et al, in U.S. Pat. No. 3,851,514, teach a machine for crimping a fitting onto a hose by means of a contractible collet assembly driven by a reciprocal ram using a downward stroke. The ram includes a pusher assembly including first and second pusher members. The collet assembly includes a plurality of segments or jaws.

Kimble et al, in U.S. Pat. No. 4,244,091, teach a hose crimping apparatus which uses radially directed crimping dies and an associated cam surface, and a ram for moving the dies relative to the cam surface in an upward stroke. The apparatus has an associated locator mounted adjacent an outer platform for controlling the length of the ram stroke.

Lillbacka et al, in U.S. Pat. No. 4,250,607, teach a machine for pressing hose couplings onto hoses radially from the circumference toward the center. The machine comprises a revolving disk in which pressing tools can be detachably fastened. The machine uses a programming or manual control device for controlling the stroke length in the pressing operation.

Gunning, in U.S. Pat. No. 4,285,228, teaches a crimping machine in which a ram is driven horizontally to crimp a workpiece using a crimping die assembly that comprises two sub-assemblies. Each sub-assembly has a plurality of die fingers fixed to a mounting plate having slots centrally disposed in grooves.

SUMMARY OF THE INVENTION

In accordance with the present invention, there is provided an improved machine for crimping a workpiece. The machine comprises a bed plate, a conical shaped bowl adjacent the bed plate having a centrally located aperture for receiving the workpiece, a crimping die assembly comprising a plurality of circumferentially spaced die fingers disposed adjacent the bowl for receiving the workpiece, a ram reciprocal along an axis toward and away from the bowl, driving means for advancing the ram toward the die assembly, and a pusher assembly between the ram and the die assembly for transmitting ram force to said die assembly. The improvement in the machine comprises a pusher assembly that comprises a single pusher ring, a die assembly that comprises a plurality of circumferentially spaced die fingers attached to a die retainer ring, and a driving means that has a variable stroke length; the length of the stroke being controlled electrically by comparing voltages on a balancing circuit.

The invention also provides a crimping die assembly comprising a plurality of die fingers, each die finger having a workpiece engaging surface, an outside surface, and side surfaces, and holding means for holding the die fingers in a working relationship. The improvement in the die assembly of the invention comprises holding means comprising a retaining ring having a plurality of substantially evenly spaced slots for holding the die fingers at one end of the die assembly, with each die finger having connecting means received within an associated slot. The connecting means is adapted for movement in the slot radially to the central axis of the retaining ring. Springing means are integrally associated with the connecting means which tend to force the die fingers radially outward. The retaining ring is adapted to receive pressing forces through a pusher ring from a ram and transfer said forces to the die fingers when the crimping die is used to crimp a workpiece.

In an alternative embodiment, the invention also provides a crimping die assembly comprising a plurality of die fingers, each die finger having a workpiece engaging surface, an outside surface, and side surfaces, and holding means for holding the die fingers in a working relationship. The improvement in the die assembly of the invention comprises holding means comprising a retaining ring having a plurality of substantially evenly spaced openings for receiving the die fingers therein such that the top of the die fingers extend above the top surface of the die retaining ring. Each die finger is made having a bottom portion and a narrower top portion and shoulders on each side thereof defining said top and bottom portions which provide sliding surfaces for movement against the side edges of the openings in the die retaining ring. Each die finger is held in its opening in the die retaining ring by a single screw which passes through the die finger laterally from the workpiece engaging surface to the outside surface and is threaded into the die retaining ring. The die finger is slidably moveable on the shaft of the screw. A coil spring is provided between the head of the screw and the die retainer ring, the screw passing through the center of the coil spring. The spring tends to force the die fingers radially outward with respect to the die retaining ring. The die assembly is adapted to receive pressing forces from the ram through the pusher ring and transfer them directly to the die fingers when the crimping die is used to crimp a workpiece.

The invention also provides a method of using the crimping machine and the die assembly which comprises the steps of inserting a workpiece into the crimping machine, setting a thumbwheel which sets the voltage in the balancing circuit at a predetermined value, driving the ram downward to contact the crimping die assembly until the voltages in the balancing circuits match, and automatically releasing the workpiece from the crimping machine.

Other aspects, embodiments, objects and advantages of this invention will become apparent from the following specification, claims and drawings.

BRIEF DESCRIPTION OF THE DRAWINGS

The accompanying drawings illustrate a present preferred embodiment of the invention, in which.

DESCRIPTION OF THE PREFERRED EMBODIMENTS

Figure 1:
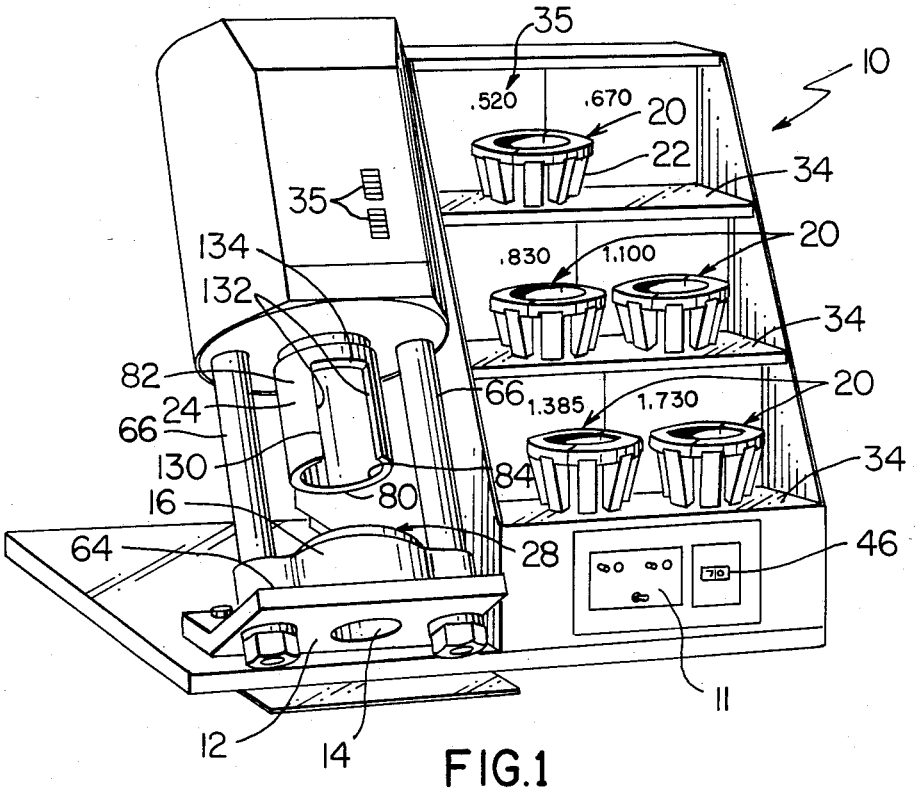
FIG. 1 is a frontal view illustrating one exemplary embodiment of the apparatus of this invention.
Figure 3:
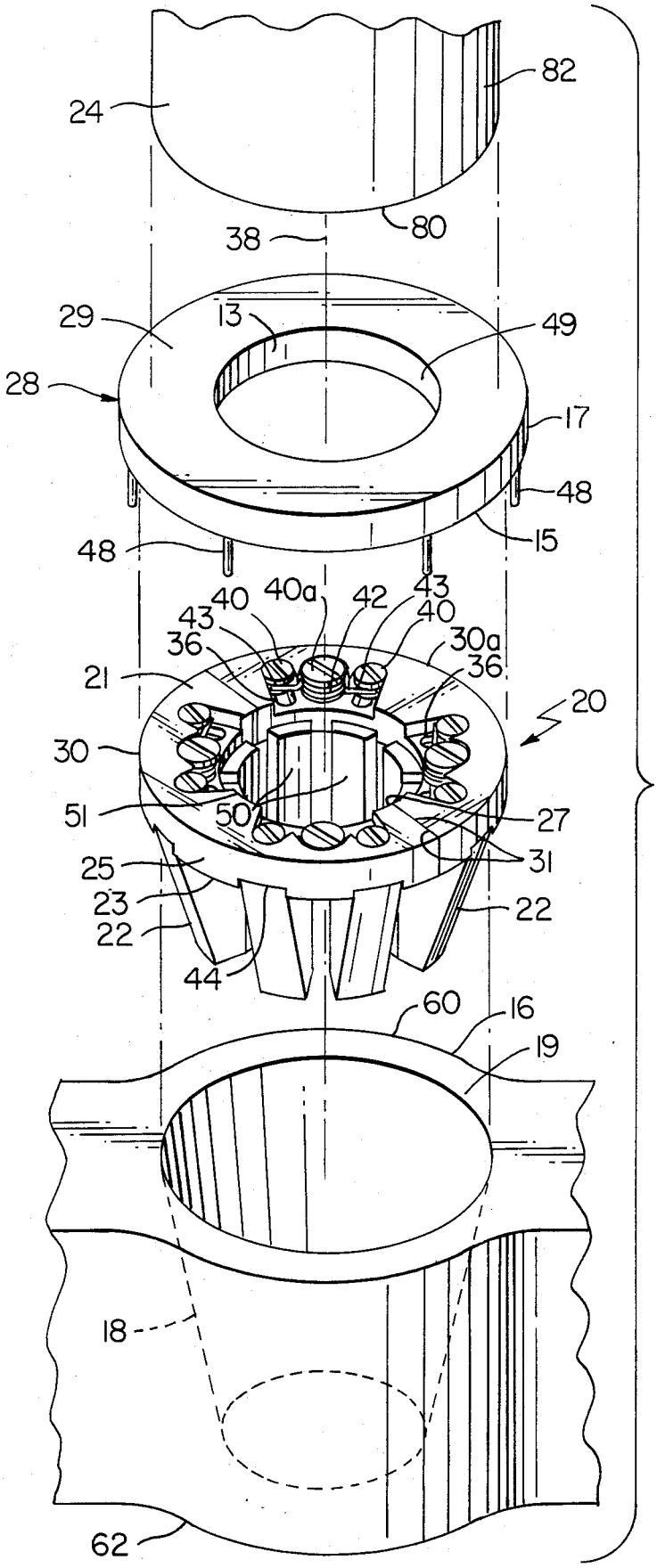
FIG. 3 is a view illustrating a portion of the assembly of the present invention illustrating the relationship of a crimping die to the ram and to the pusher ring assembly of the invention.

Reference is now made to FIGS. 1 and 3 of the drawings which illustrate one exemplary embodiment of a crimping machine or apparatus of this invention which is designated generally by the reference number 10. The apparatus comprises a bed plate 12 having an aperture 14 for receiving a workpiece, a conical shaped bowl 16 having a bottom 62 which is adjacent to the the top 64 of said bedplate 12, conical bowl 16 having a centrally located aperture 18 for receiving a workpiece, (see also FIGS. 9 and 10), and a crimping die assembly, designated generally by the reference number 20, disposed adjacent conical bowl 16. Crimping die assembly 20 comprises a plurality of die fingers 22 which are disposed circumferentially in the crimping die assembly 20. The circumferential relationship of the die fingers 22 is suitable for receiving a workpiece within the die fingers during a crimping operation of the apparatus. A ram 24, the crimping die assembly 20, aperture 18 of conical bowl 16, and aperture 14 of bedplate 12 are disposed on the longitudinal axis 38 (see FIG. 3). Ram 24 is supported in the apparatus by support struts 66. Ram 24 is generally circular in shape, so as to match the geometry on the crimping die assembly 20. Ram 24 is a cylindrical structure having a bottom edge 80, an outer wall 82, and an inner wall 84. The area defined by inner wall 84 is suitable for receiving a workpiece into the ram 24 during the crimping operation of the apparatus 10. Indicia 35 are provided on the machine for easy reference in determining which die is to be used for a particular crimping operation, as is described below. In the preferred embodiment, shelves 34 are integrally attached to the apparatus for convenience in storing the several crimping dies 20 which are used in the apparatus 10. An on/off switch, and lights indicating the status of the machine, are provided on control panel 11. A thumbwheel device 46 is located on the front of the machine. Thumbwheel device 46 is used to set a predetermined reference voltage in a balancing circuit for determining the stroke length of ram 24 in a particular crimping operation.

Although, in FIG. 1, the apparatus of the present invention is illustrated as having the ram disposed to provide an upward downward stroke at an angle slightly out of perpendicular, it should be recognized that any predominantly up and down angle that is desired, including perpendicular up and down, may be used in the crimping machine of the invention.

Figure 2:
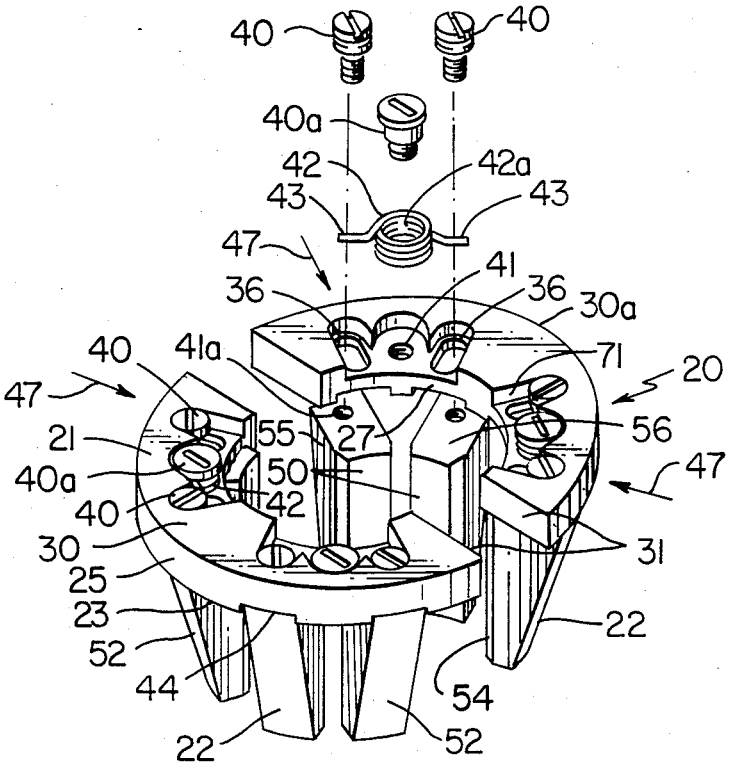
FIG. 2 is an elevated, partially exploded view of the preferred embodiment of the crimping die assembly of this invention.
Figure 7:
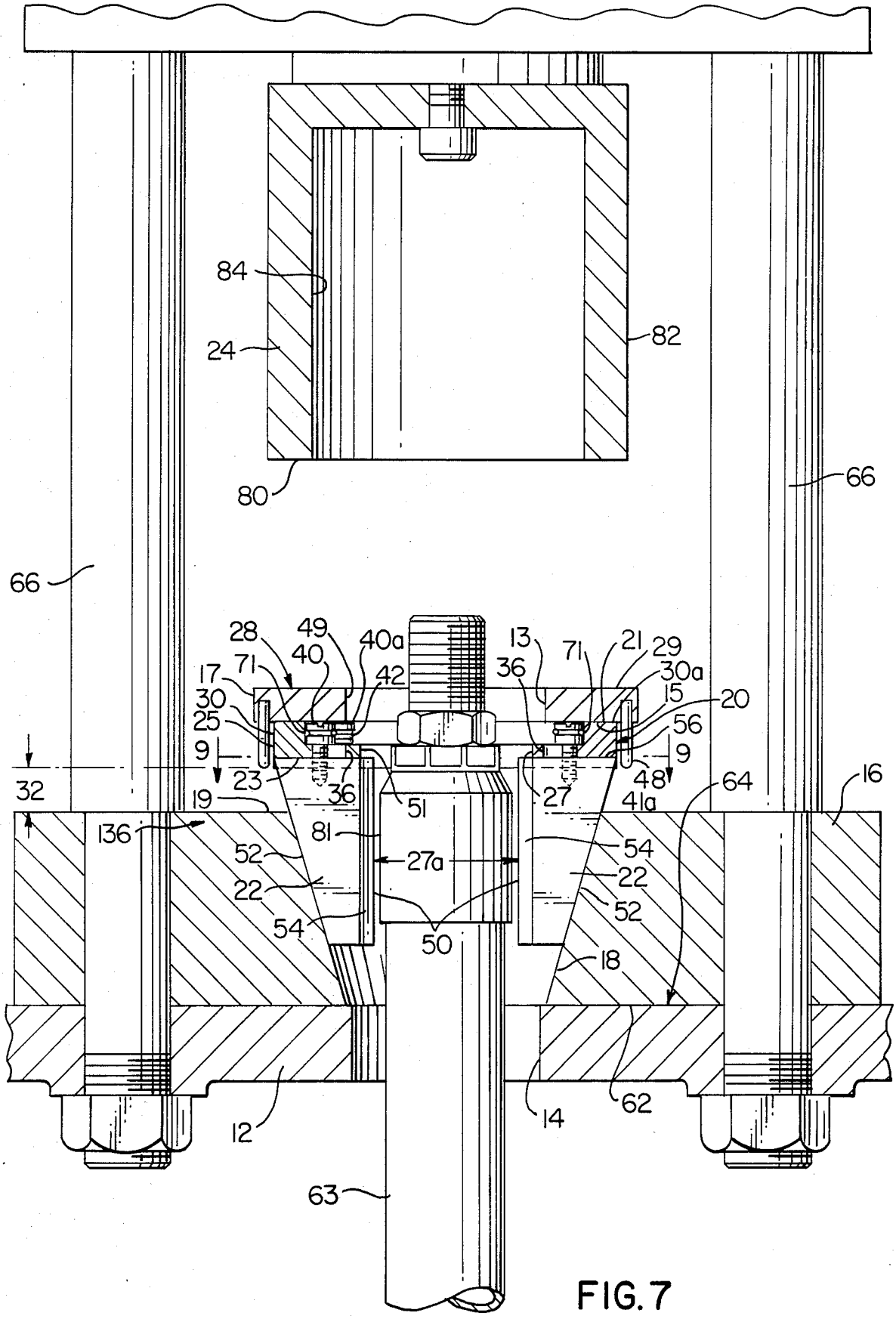
FIG. 7 illustrates the apparatus of the invention in the starting position in its use in crimping a workpiece.

Reference is now made to FIG. 2 of the drawings which illustrates one embodiment a crimping die 20, which is used with apparatus 10 for crimping a workpiece 81 (see FIG. 7). The crimping die assembly 20 of the invention comprises die fingers 22 having an inside or crimping surface 50, an outside or conical bowl engaging surface 52, wedge-shaped side surfaces 54 and parallel side surfaces 55. Die fingers 22 are held together in the crimping assembly 20 by means of a retainer ring which comprises ring halves 30 and **30*a*. (As used herein, the number 30 will be used to represent both halves 30 and 30*a* of the retainer ring unless otherwise noted.) Retainer ring 30 has a generally circular outside surface 25, a bottom surface 23 which has notches 44 for receiving die fingers 22**, and a top surface 21 which has recesses 71 in which are integrally received springing means 42 and fastening means, said fastening means comprising cap screws 40 and 40*a*.

Slot 36 is disposed within the recess 71 to receive cap screw 40 therethrough to be disposed in threaded hole 41*a* in the top 56 of die finger 22. A separate threaded cap screw 40*a* is received through a central opening 42*a* in said springing means to be received in threaded hole 41 in the die retaining ring 30. Springing means 42 is provided with extensions 43. When assembling the crimping die assembly, cap screws 40 are disposed behind extensions 43, i.e. on that side of extensions 43 which is furthest from inside surface 27 of die retaining ring 30. Disposing the cap screws 40 behind extensions 43 as described above assures that die fingers 22, when not under stress, will be disposed in a circle, relative to one another, having the maximum diameter permitted by retaining ring 30. When die fingers 22 are subjected to stress, such that they are forced into a smaller diameter, such as when they are forced into conical bowl 16, (see FIGS. 7–10), extensions 43 of springing means 42 will be bent toward the inside surface 27 of die retaining ring 30 because of the corresponding movement of cap screws 40*a*. When stress on the die fingers 22 is removed, extensions 43 of springing means 42 will tend to push die fingers 22 back in slot 36 to their starting position. Slot 36 is provided in an oblong shape in order to permit such movement. In the preferred embodiment, notches 44 are provided as a guide in the bottom surface 23 of die retaining ring 30 to control the direction of the movement of the die fingers. The two halves 30 and 30*a* of the die retaining ring are provided with flat smooth end surfaces 31 which permit tight engagement of the two halves of the die assembly 20. Arrows 47 illustrate the inward radial movement which the die fingers undergo when the die assembly 20 is pressed into conical-shaped bowl 16.

In the preferred embodiment, die finger 22 will have a slightly curved crimping surface 50 which is suitable for engaging the circumference of a workpiece 81. Since workpieces come in a variety of sizes, a number of crimping die assemblies are provided in which the arc of the curve of surface 50 may be closely matched to the arc of the outside circumference of the workpiece. The circumference of the area embraced by the die fingers 22 in the crimping die assembly 20 provided varies due to differences in the thickness of die fingers 22 as measured by the length of wedge-shaped side surfaces 54. Preferably outside surface 52 of die fingers 22 will match the curvature of conical bowl 16 for each die assembly provided. Those skilled in the art will recognize, however, that other suitable configurations for surface 52 in the die fingers 22 may be provided. For example, the die fingers 22 may have a flat surface 52, or a concave curved surface, or any other surface designed to reduce the coefficient of friction between die fingers 22 and conical bowl 16. The wedge-shaped side surfaces 54 will be the same for each crimping die assembly provided with regard to side angles, and will differ from one another only with regard to length. The die fingers in each crimping die are otherwise identical. The die retaining ring 30 may have exactly the same circumference, thickness, and inside diameter for all crimping die assemblies provided. In the preferred embodiment of the invention, each crimping die assembly 20 has a die retaining ring 30 of a different color, said color matching indicia on the crimping machine for easy identification of the crimping die assembly.

Reference is now made to FIG. 3 which illustrates essential components of the die assembly and crimping apparatus which are used in a crimping operation. In a crimping operation, the crimping die assembly 20 is disposed in conical bowl 16, a pusher ring assembly 28 is disposed adjacent crimping die assembly 20, and ram 24 is disposed adjacent pusher ring assembly 28. Conical bowl 16 has an outer wall 60, a top edge 19 and inside surface 18. Crimping die assembly 20, as mentioned above, has recesses 71 which receive fastening means 40 and 40*a* and springing means 42 so that the top upper surface 21 of die retaining ring 30 is smooth and flat for disposition against a smooth and flat bottom surface 15 of pusher ring assembly 28. Pusher ring assembly 28 has an aperture 49 for receiving a workpiece therethrough, an inside surface 13 defining said aperture 49, an outside surface 17, and a smooth and flat top surface 29 which is adapted to contact the smooth and flat edge 80 of ram 24. It is essential that all contacting surfaces 80, 29, 15, 21, 18, 52 and 50 be uniform and smooth in order to provide a complete and well-distributed transfer of forces from the ram 24 to the workpiece 81 (FIG. 8) in a crimping operation.

Pusher ring assembly 28 may be provided with retainer posts 48 which are used to hold pusher ring 28 in position on die retainer ring 30 during machine set up in the crimping operation.

Although, in the preferred embodiment, retaining posts 48 are used as holding means to hold the pusher ring assembly 28 in position on the die retaining ring 30, other equivalent holding means may be used. For example, the die retaining ring 30 and the pusher ring 28 may be provided with matching grooves, the pusher ring 28 may be provided with a lip that fits over the outside surface 25 of the die retaining ring 30, or teeth may be provided in the pusher ring which mesh with corresponding holes or grooves in the die retainer ring 30. Other equivalent means of holding the pusher ring assembly on the crimping die assembly 20 will be apparent to those skilled in the art.

Ram 24, pusher ring assembly 28, die assembly 20 and conical shaped bowl 16 are disposed generally on longitudinal axis 38, said longitudinal axis 38 being the line of disposition of a workpiece which is to be crimped.

Figure 4:
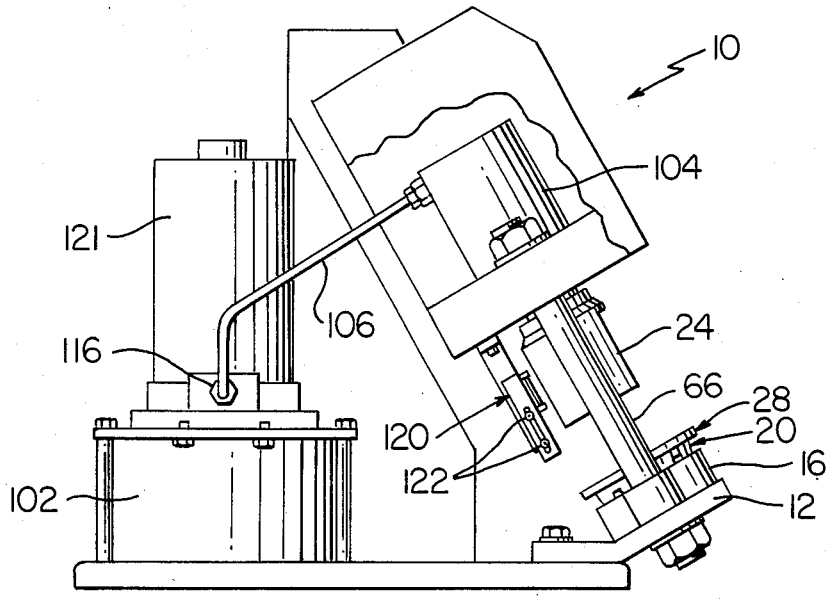
FIG. 4 illustrates the fluid system which operates the driving means of the apparatus of the invention.

Reference is now made to FIG. 4 which illustrates a fluid system which is used as a driving means for ram 24. The driving means comprises reservoir chamber 102, piston cylinder 104 which is disposed adjacent to ram 24, and connecting means 106 which provides for passage of fluid between reservoir chamber 102 and piston cylinder 104. Connecting means 106 may be tubing, hose, or any other means suitable for conveying fluids at the pressures used herein. Fluid is transferred between chamber 102 and cylinder 104 by pump 121.

Figure 5:
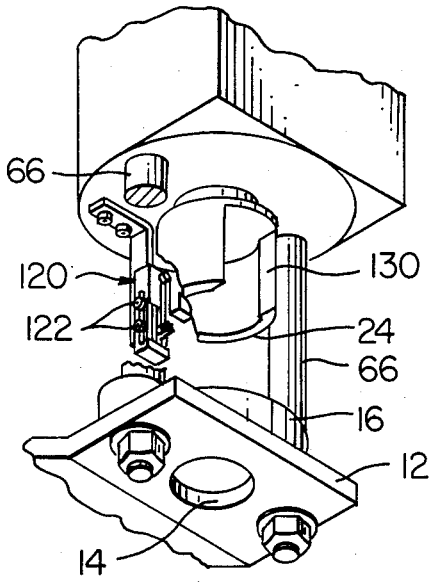
FIG. 5 is a view illustrating the potentiometer used to measure the stroke length of the apparatus of the invention.
Figure 6:
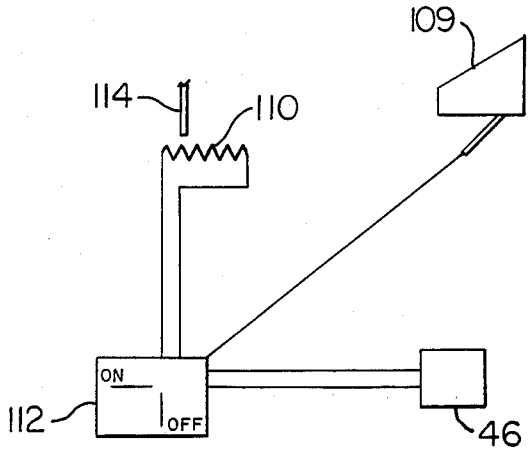
FIG. 6 illustrates some of the circuitry used in the control mechanism which controls the stroke length of the ram in the apparatus of the invention.

The apparatus 10 of the invention has a balancing circuit which controls the amount of fluid which passes from reservoir chamber 102 to piston cylinder 104 which thereby controls the length of the stroke of ram 24 in the crimping operation. A simplified version of the balancing circuit of the invention is illustrated in FIG. 6. The balancing circuit comprises two component parts, one of which includes thumbwheel 46 and its associated components, and the other includes resistor 110 and its associated components. As can be seen in FIG. 6, power is provided to the apparatus by power source 109. Thumbwheel 46, which is associated with the balancing circuit, (said circuit includes operational amplifiers, digital analog convertors, and associated peripheral components to provide a reference voltage for said balancing circuit) is set to a preset reference voltage (the voltage in the thumbwheel circuit varies in proportion to the digits selected on the thumbwheel 46 by means that will be recognized by those skilled in the art) that is deterained for a specific crimping operation as is described below. As ram 24 moves down in its stroke in the crimping operation, the voltage across resistor 110 in potentiometer 120 (See FIG. 5) varies with the position of the sliding or wiper arm 114, which is connected to ram 24, as sliding arm 114 moves across resistor 110.

The resistance in the resistor 110 in the potentiometer 120 increases as the length of the ram stroke increases, thereby increasing the comparative voltage in the balancing circuit. Logic circuitry 112 is provided with a comparator, integrated circuits (IC) and a solid state relay. The IC and the solid state relay control the pump as described below. The comparator recognizes the relative magnitude of the voltage in the two components of the balancing circuit. When the voltage across resistor 110 matches or exceeds the voltage which is preset by the thumbwheel 46, the logic in the circuitry flip-flops in value and automatically turns off pump 121, which transfers fluid from reservoir chamber 102 to piston cylinder 104, and thereby stops the forward motion of ram 24 in the crimping operation. In the preferred embodiment of the invention, apparatus 10 is provided with a valving system 116 which automatically reverses the flow of the fluid in apparatus 10 from piston cylinder 104 to reservoir chamber 102 when an electronic latch in the logic circuitry 112 is activated when the voltage in the circuit, measuring the ram stroke, matches or exceeds the preset reference voltage set by the thumbwheel 46. The latch in the logic circuitry 112 assures that the pump 121 will not restart as the ram 24 returns to its starting position unless the start button is pushed. The potentiometer 120 which contains variable resistor 110 is illustrated in FIG. 5. For convenience, adjustment screws 122 are associated with potentiometer 120 for calibrating the apparatus 10 from time to time as needed.

As noted above, the logic in the circuit provides a flip-flop which changes the value in the circuit. For example, when the value is 0, the ram moves downward since the pump is moving fluid from the reservoir chamber 102 to the piston cylinder 104. When the circuit becomes balanced because of an increase in voltage across resistor 110, the logic value goes to 1, which disables the comparator and causes the pump to stop. Because of the valving system, fluid bleeds from the piston cylinder 104 to the reservoir chamber 102. A spring may be provided in the piston cylinder 104 to aid the return of the ram 24 to its starting position.

As will be apparent to those skilled in the art, when the flow of fluid in the system is reversed, the ram 24 returns to its starting position in the apparatus. For convenience, a stop button is provided on control panel 11 which, when activated, reverses the logic in the circuit, and stops the apparatus in the same manner as is described above. If desired, the machine may be started at any time it is in the off condition merely by pressing a start button.

Reference is now made to FIG. 7 which illustrates the position of the ram 24 when the crimping apparatus 10 is in the start position. As can be seen in the drawing, when placed in the conical bowl 16, die retainer ring halves 30 and **30*a* define an aperture 51 which surrounds a workpiece 81 which is inserted into the apparatus along longitudinal axis 38 in the machine 10. The open area in ram 24, defined by side edges 132 and top edge 134, makes it possible to crimp curved workpieces since the curved end of a workpiece may extend from ram 24 through opening 130 which is defined by edges 132 and 134. The position of the crimping die assembly 20 is illustrated by the arrow 32 which represents the distance from the bottom surface 23 of die retaining ring 30 to top 19 of conical shaped bowl 16. Arrows 27*a* illustrate the diameter of die fingers 22** in the start position.

Providing the crimping die assembly 20 in two halves, as described above, also facilitates the crimping of bent workpieces since a bent workpiece may be inserted into the conical bowl 16 of crimping apparatus 10, and thereafter the two halves of the crimping die assembly, which are associated with die retaining rings 30 and **30*a*, can be inserted into the conical bowl 16** around said bent workpiece.

Figure 8:
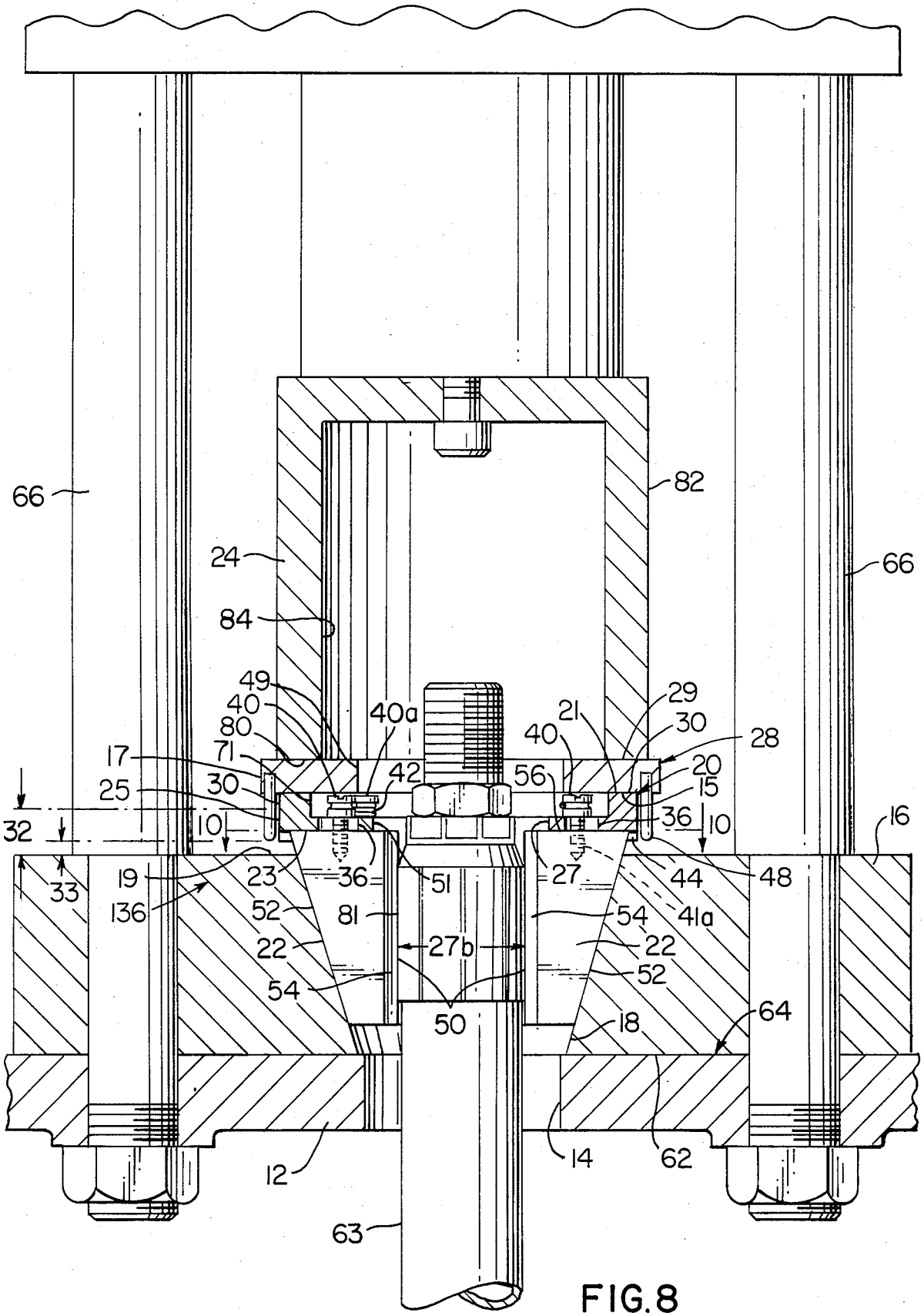
FIG. 8 illustrates the apparatus of the invention in the crimp position in its use in crimping a workpiece.
Figure 9:
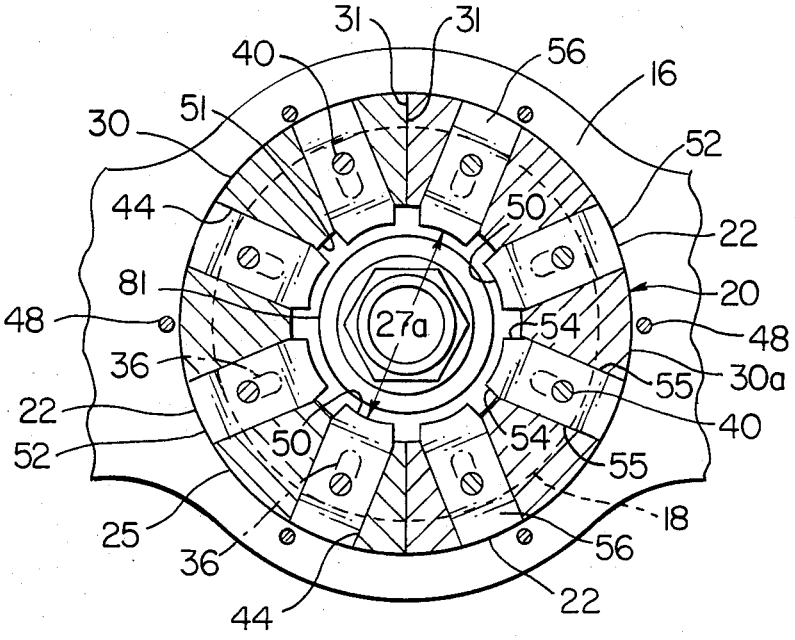
FIG. 9 illustrates the position of the crimping die fingers in the apparatus of the invention in the start position.
Figure 10:
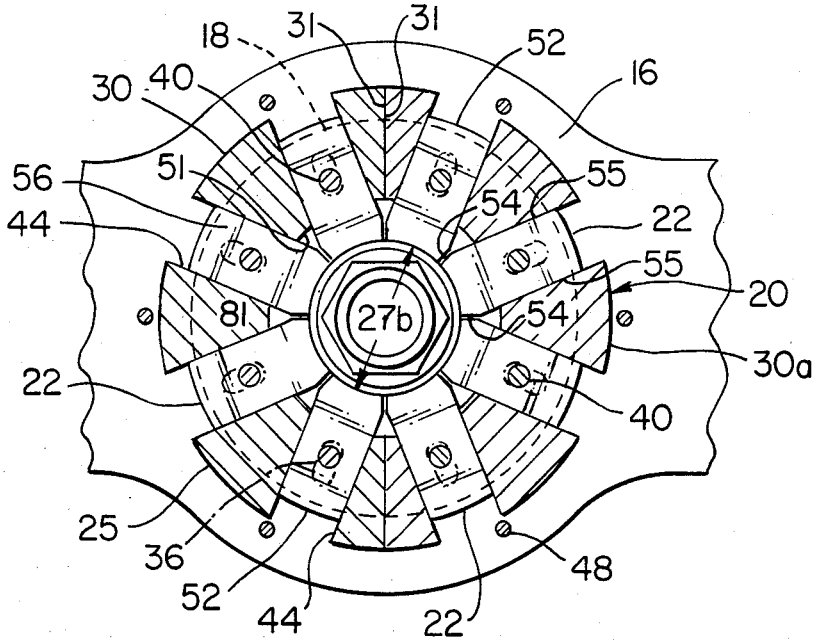
FIG. 10 illustrates the crimp position of the die fingers of the crimping die in the apparatus of the invention when used to crimp a workpiece.

Reference is now made to FIG. 8 which illustrates the position of the crimping die assembly 20 when ram 24 has been driven into the crimping position. Arrow 33 illustrates the position of die retaining ring 30 in the crimping position, which is compared with arrow 32 which illustrates its start position. Arrows **27*b* illustrate the new diameter of die fingers 22 as die fingers 22 compress workpiece 81 in the crimping operation. FIGS. 9 and 10 also illustrate the relative positions of the die fingers 22** in the starting and crimping position in the crimping operation.

Figure 11:
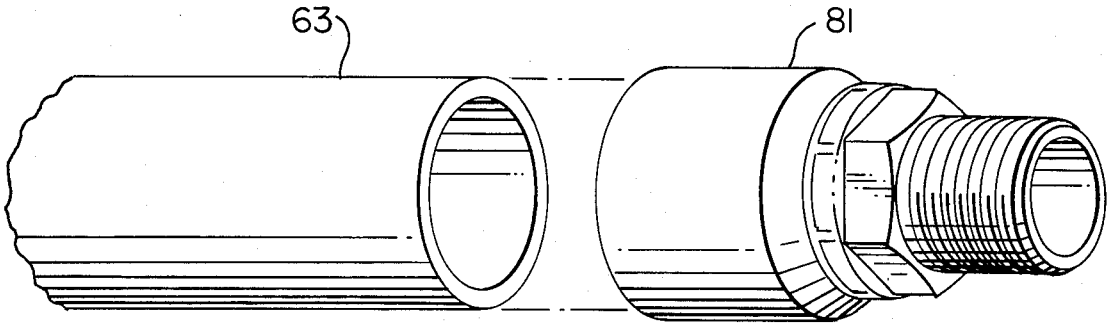
FIG. 11 illustrates a hose and a coupling which may be crimped in the apparatus of the invention.
Figure 12:
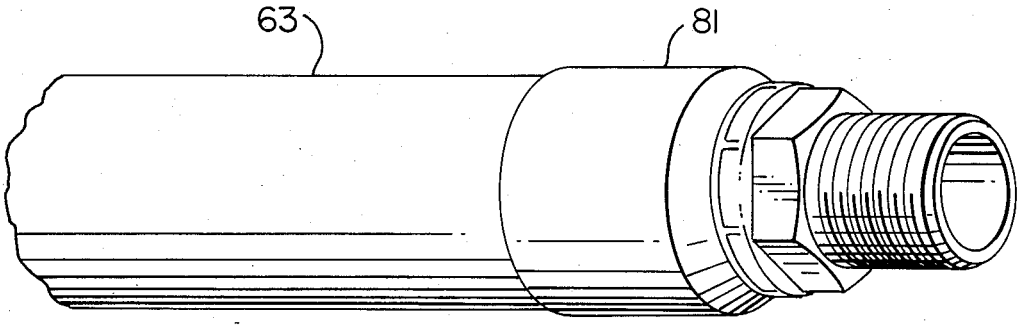
FIG. 12 illustrates an assembled hose and coupling prior to crimping in the apparatus of the invention.
Figure 13:
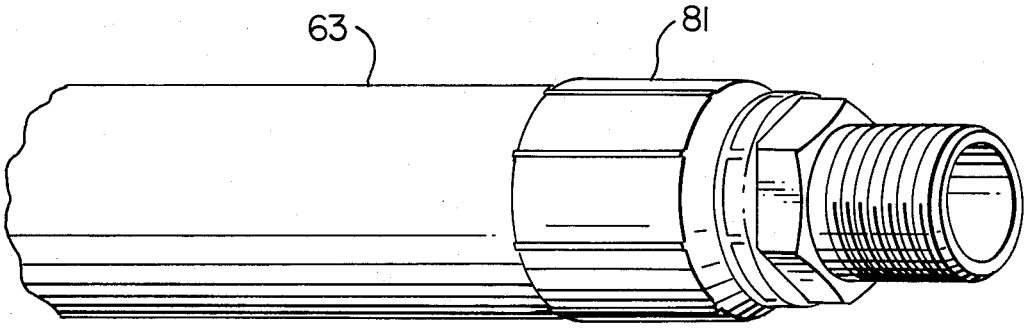
FIG. 13 illustrates a crimped hose and coupling assembly.

Reference is now made to FIGS. 11 and 12 which illustrate how, for example, a coupling 81 will be assembled with a hose 63 before subjecting said assembly to the crimping operation. FIG. 13 illustrates the hose and coupling assembly after it has been crimped.

As will be appreciated by those skilled in the art, because the stroke length of the ram 24 is always the same whenever the thumbwheel is set to the same setting, the net change in the diameter of die fingers 22 in a crimping die assembly 20 will also be the same whichever crimping die assembly is used. Since, as noted above, the crimping die assemblies 20 which are used with the apparatus 10 of the present invention differ from each other only in the thickness of the die fingers 22 defined by the length of wedge-shaped sides 54 of die fingers 22, and the length of the ram stroke can be controlled, it will be apparent that, as contrasted with the crimping machines of the prior art, a single pusher ring and a single conical bowl may be used with the crimping apparatus of the present invention to crimp a wide variety of work pieces since crimp diameters are controlled by the length of the ram stroke.

As noted above, a number of embodiments of a die assembly 20 may be used in the crimping apparatus 10 of the invention. One such alternative embodiment is illustrated in FIGS. 14–18. In FIGS. 14–18, a crimping die **20*a* is illustrated in which die retaining ring 30*b* (which comprises die retaining ring halves 30*b* and 30*c*) has openings 170 (FIG. 17) which are adapted to receive die fingers 22*a* which are made having shoulder 150 which provides a delineation between parallel side surfaces 55 and narrower parallel side surfaces 162 defining top portion 161. Shoulder 150 is adapted for sliding movement against bottom edge surface 164 (FIG. 15) of opening 170. As is apparent from the figures, opening 170 is made having a width somewhat less than the width of parallel side surfaces 55. Narrower parallel side surfaces 162 are adapted to fit within opening 170 and make sliding contact against side walls 152. Thc top surface 158 of die finger 22***a* is made to extend above the top surface 21 of die retaining ring 30*b* by a distance represented by edge 160 of die finger 22*a*. Since top surface 158 extends above die retaining ring 30*b*, it will be apparent, that in this embodiment, the pusher ring 28 will apply the forces of the ram 24 directly against die fingers 22*a*. The advantages of reducing the number of contact surfaces in the die assembly will be apparent to those skilled in the art.

Figure 16:
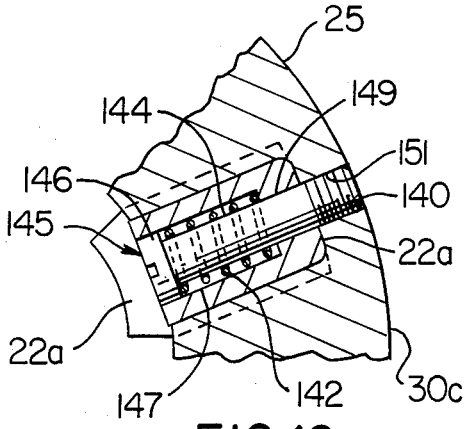
FIG. 16 illustrates the position of a die finger in the start position.
Figure 15:
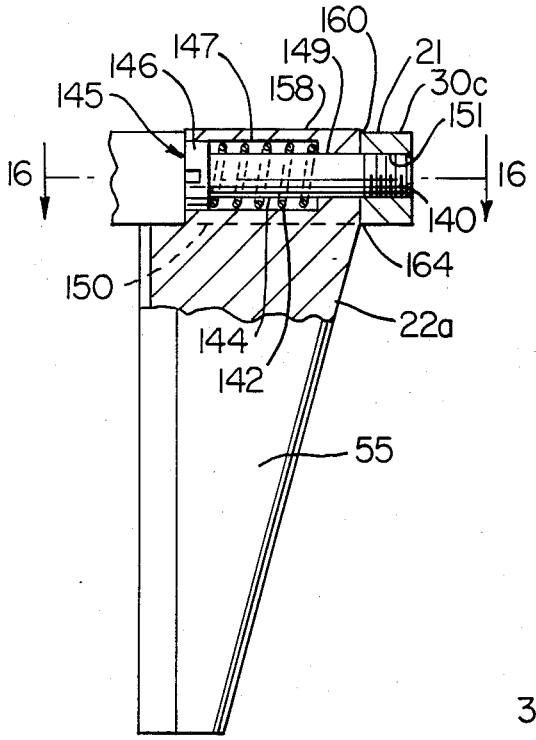
FIG. 15 illustrates a second embodiment of a die finger attached to a die retaining ring.
Figure 17:
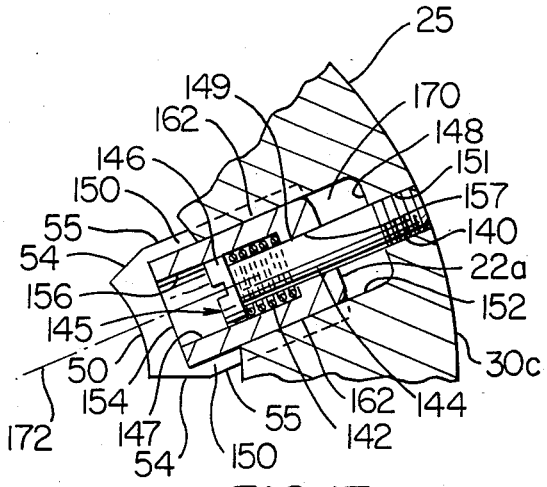
FIG. 17 illustrates the position of a die finger in the crimp position.

Die fingers 22*a* are connected to die retaining ring 30*b* as is illustrated in FIGS. 16 and 17. Die finger 22*a* has large bore cavity 147 and bore hole 149 in top area 161 which are drilled having sides 156 and 157 parallel to sides 162. Threaded hole 151 is provided in die retaining ring 30*b* in outside surface 25. Opening 170, threaded hole 151, bore cavity 147 and bore hole 149 are provided on the same central axis 172. Connecting means, generally designated by reference number 145 which comprises head 146, shaft 144 and threaded end 140 is provided to pass through opening 154 in top area 161 of die finger 22*a* to connect die finger 22*a* to die retaining ring 30*b*. Head 146 is provided having substantially the same diameter as bore cavity 147 and shaft 144 is provided to have substantially the same diameter as bore hole 149. Threaded end 140 is adapted to provide attachment in threaded hole 151. Die finger 22*a* is adapted for sliding movement on shaft 144 and head 146 of connecting means 145. The extent of sliding motion of die finger 22*a* is limited by end wall 148 of opening 170 and the length of shaft 144. Compression spring 142, which is placed around shaft 144, tends to force die fingers 22*a* radially outward with respect to die retaining ring 30*b*. Shaft 144, and head 146, together with opening 170 and shoulder 150, control the direction of movement of die fingers 22*a* in a crimping operation.

At the start of a crimping operation, die finger 22*a* will be in the start position illustrated in FIG. 16 where spring 142 is fully extended. As die fingers 22*a* are forced inward by downward movement into conical bowl 16 in the crimping operation, spring 142 becomes compressed as is illustrated in FIG. 17. When the crimping operation is complete, the compressed spring 142 tends to push die finger 22*a* radially outward.

Figure 14:
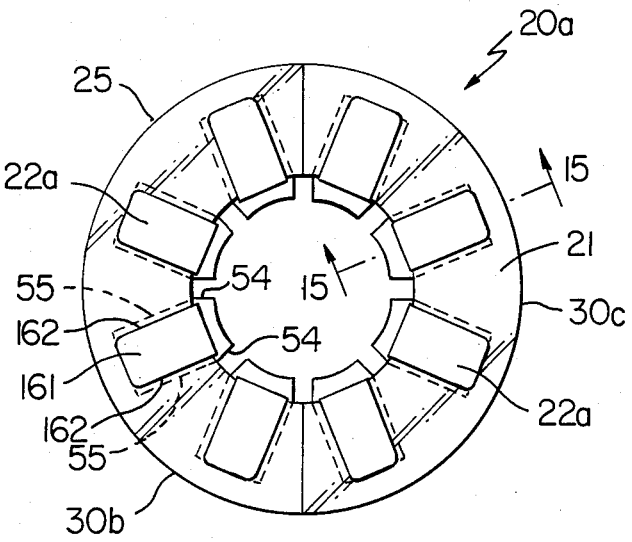
FIG. 14 illustrates a second embodiment of a crimping die assembly of the invention.
Figure 18:
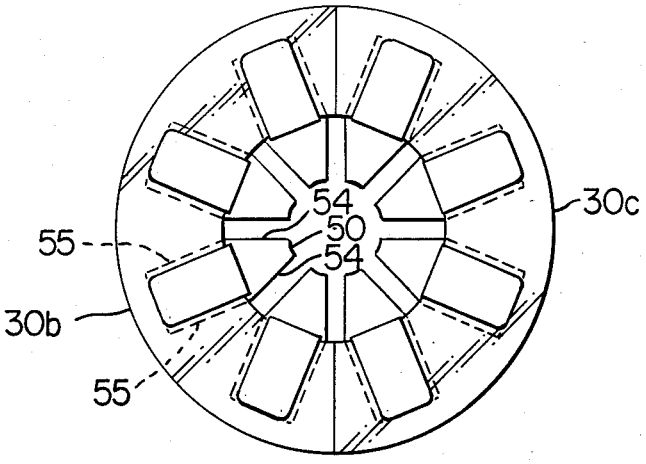
FIG. 18 illustrates a crimping die assembly similar to FIG. 14 which is adapted for crimping small workpieces.

Reference is now made to FIG. 18 which illustrates a crimping die assembly adapted for use on a small workpiece as contrasted with the die assembly of FIG. 14 which is adapted for use on a large workpiece. The die assembly of FIG. 14 differs from the die assembly in FIG. 18 only by the length of wedge-shaped sides 54.

To use the crimping apparatus of the present invention, one skilled in the art must choose the specific crimping die assembly 20 which is needed based on the size of the workpiece which is to be crimped. The specific crimping die assembly 20 chosen is useful in crimping a workpiece in a small range of sizes. For example, the crimping die assembly 20, marked with a red die-retaining ring 30, can be used to crimp workpieces in the range of 0.520 to 0.670 inch. For a specific workpiece in that size range, a thumbwheel setting is chosen such that die fingers 22 are compressed to the desired diameter. For example, 4R3 (Dayco) hose having a $\frac{1}{4}$ inch I.D. (inside diameter), which is to be assembled with a 4DE ferrule (Dayco specifications), which has a crimp 0.D. (outside diameter) of 0.550 inch, will require a digital setting of 63 on thumbwheel 46. Similar specifications can be obtained for any workpiece which is to be crimped with the apparatus of the invention.

One skilled in the art will recognize that fluid systems, specifically hydraulic systems, can be provided in many desired specifications. The crimping apparatus of the present invention has been made using 30 ton, 50 ton and 100 ton fluid systems. In the preferred embodiment, a 50 ton hydraulic system is used in the apparatus of the invention.

By providing a balancing circuit which controls the stroke length of the downward stroke of the ram 24, no contact mechanisms which are used to indicate the end of the stroke, as used in prior art machines, are required. Contact mechanisms in the prior art machines have a tendency to wear, which eventually may cause errors in the crimp diameter which is achieved. Also, since the control mechanism of the apparatus of the invention is automatic, there is no requirement that an operator be assigned to make judgments as to when the crimping operation is complete, as is required with the prior art machines. This also limits the possibility of human error in the crimping operation.

Since the valve assembly in the apparatus of the invention is designed to bleed (transfer fluid from the piston cylinder to the reservoir chamber) automatically in response to the flip-flop in the value in the logic of the system, the operator does not have to turn a switch to release the crimping apparatus from the workpiece after completion of the crimping operation.

In the use of the crimping apparatus 10 of the invention, the machine operator must first determine which crimping die 20 should be used to crimp a particular workpiece 81. Crimping dies used in the preferred embodiment of the invention may be provided in the following sizes, and are provided with the following color codes:

| SIZE | COLOR |
|---|---|
| 0.350 | Orange |
| 0.520 | Red |
| 0.670 | Yellow |
| 0.830 | Blue |
| 1.100 | Green |
| 1.385 | Black |
| 1.730 | Clear |

If, for example, a 4R8 hose, having a $\frac{1}{4}$" I.D. is to be fitted with a 4DE coupling, the machine operator selects the red coded crimping die assembly 20 which is useful for crimping workpieces having a diameter in the range of 0.520–0.670 inch. By checking the specifications of the coupling used, the operator will know that the final crimp diameter of the coupling should be about 0.585 inch. The thumbwheel setting which is required to provide a proper crimp for a specific coupling, using a specific die assembly, can be determined from a specifications chart. The operator then sets the thumbwheel 46 to 94, the proper setting, and inserts the workpiece 81, pusher ring assembly 28, and the crimping die assembly 20 into the crimping apparatus 10. The thumbwheel setting establishes a preset voltage in the balancing circuit in the machine. The operator then pushes the start button which sets the logic in the circuitry of the apparatus to the value 0. When the value of the logic in the apparatus is 0, the pump 121 transfers fluid from reservoir chamber 102 to piston cylinder 104. Fluid pressure in piston cylinder 104 causes downward motion of ram 24 which drives crimping die assembly 20 downward into conical bowl 16, and forces die fingers 22 radially inward to reduce the diameter of die fingers 22. As ram 24 advances, the resistance across potentiometer 120 increases, thereby increasing the voltage across the potentiometer 120. When the voltage across potentiometer 120 matches the voltage across the potentiometer associated with thumbwheel 46, the crimping operation is complete and the logic in the comparator changes value from 0 to 1. When the value of the logic in the comparator is 1, the action of pump 121 is stopped and fluid is permitted to bleed from piston cylinder 104 to reservoir chamber 102 and ram 24 reverses the direction of its motion. Springing means 42 tends to cause die fingers 22 to release from the workpiece 81. The operator may then remove the workpiece from the machine and check its final diameter.

While present exemplary embodiments of this invention, and methods of practicing the same have been illustrated and described, it will be recognized that this invention may be otherwise variously embodied and practiced within the scope of the following claims.

What is claimed is:

1. In a crimping die assembly comprising a plurality of die fingers; each said die finger having a workpiece engaging surface, a top surface, a bottom surface an outside surface and side surfaces with the distance between the top surface and bottom surface defining its length; holding means for holding said die fingers in a working relationship, said holding means comprising a retaining ring having a plurality of substantially evenly spaced openings for receiving said die fingers therein for holding said die fingers at one end of said die assembly, said retaining ring having a top surface and a bottom surface and a central axis with the distance between the top surface and bottom surface defining its thickness, each said die finger having connecting means connecting said die finger to said retaining ring, each said connecting means permitting only radial movement of its respective said die finger with respect to said central axis of said retaining ring; and springing means integrally associated with said connecting means tending to force said die fingers radially outward with respect to said retaining ring, the length of said die fingers being greater than said retaining ring thickness so that an outside surface extends below the bottom surface of said retaining ring and is configured to contact a conical shaped bowl of a crimping machine the improvement wherein said top surfaces of said die fingers extend beyond said top surface of said retaining ring so as to receive pressing forces directly from a ram through a pusher ring that engages said top surfaces of said die fingers when said crimping die is used to crimp a workpiece.

2. The crimping die assembly of claim 1 in which said retaining ring is made in two semicircular halves such that each half of said crimpling die can be placed into a crimping machine after the workpiece is inserted into the machine in order to facilitate the crimping of curved workpieces.

3. The crimping die assembly of claim 1 in which each said connecting means passes through its respective die finger laterally from said workpiece engaging surface thereof to said outside surface thereof and is connected to said retaining ring, each said die finger being radially slideable on its respective connecting means.

4. The crimping die assembly of claim 3 in which said connecting means is a screw which is threaded into said die retaining ring.

5. The crimping die assembly of claim 3 in which said springing means comprises a plurality of coiled compression springs respectively telescopically receiving said connecting means therethrough.

6. The crimping die assembly of claim 1 in which said die fingers each has a top portion and a bottom portion with said top portion having a lateral length side-to-side which is less than the lateral length side-to-side of said bottom portion, each die finger having a shoulder on each side thereof that define said top and bottom portions thereof, said shoulders of each die finger slidably contacting side edges of its respective opening in said retaining ring to provide a guide surface for said radial motion of that die finger in a crimping operation.

* * * * *